United States Patent [19]

Derka

[11] 4,095,668

[45] Jun. 20, 1978

[54] SOUND SUPPRESSING MACHINE COVER

[75] Inventor: Edward A. Derka, Des Plaines, Ill.

[73] Assignee: A.B.C.C.O. Industries, Incorporated, Wood Dale, Ill.

[21] Appl. No.: 700,361

[22] Filed: Jul. 6, 1976

[51] Int. Cl.[2] ..... G10K 11/00

[52] U.S. Cl. ..... 181/202; 181/205; 181/290; 181/287

[58] Field of Search ..... 181/33 K, 202, 205, 181/290, 293; 164/6

[56] References Cited

U.S. PATENT DOCUMENTS

| | | | |
|---|---|---|---|
| 2,701,024 | 2/1955 | Thomas | 181/33 K |
| 3,785,452 | 1/1974 | Scott | 181/33 K |
| 3,960,237 | 6/1976 | Sleeper | 181/33 K |

FOREIGN PATENT DOCUMENTS

| | | | |
|---|---|---|---|
| 761,751 | 6/1967 | Canada | 181/33 K |

*Primary Examiner*—L. T. Hix
*Assistant Examiner*—Benjamin R. Fuller
*Attorney, Agent, or Firm*—Bernard L. Kleinke

[57] ABSTRACT

A cover for suppressing sound from a machine includes a pair of cover members having sound suppressing material thereon and connected to and supported by a pair of oppositely-disposed brackets mounted on the base of the machine. The cover members may be positioned in a horizontal plane in a closed position at least partially over the machine, and at least one of the cover members is pivotally connected to the brackets to move to an upstanding disposition in an open position. Stop members limit the movement of the pivotally mounted cover member between its open position and its closed position.

9 Claims, 4 Drawing Figures

SOUND SUPPRESSING MACHINE COVER

The present invention relates in general to a sound suppressing machine cover, and it more particularly relates to a cover for suppressing noise from a machine, such as a vibratory deburring and finishing machine.

Machines, such as vibratory deburring and finishing machines, oftentimes produce high sound levels, and it is desirable to reduce the sound levels for providing more pleasant working conditions for the operating personnel. For example, hard covers have been provided for vibratory deburring and finishing machines to help reduce the sound levels. However, such sound suppressing covers have not been entirely satisfactory for some applications in that the hard covers do not readily absorb the sound. Therefore, it would be highly desirable to have a sound suppressing cover which is better able to reduce sound levels and which is relatively less expensive to manufacture and is efficient in operation.

Therefore, the principal object of the present invention is to provide a new and improved sound suppressing machine cover, which is better able to reduce sound levels and which is relatively inexpensive to manufacture and convenient to use. Briefly, the above and further objects of the present invention are realized by providing a sound suppressing cover which includes a pair of cover members having sound suppressing material thereon and connected to and supported by a pair of brackets mounted to the machine. The cover members are disposed in a horizontal plane when in their closed position for at least partially extending over the machine, and at least one of the cover members is pivotally connected to the brackets to move to an upstanding disposition in an open position. Stop means are provided for limiting the movement of the pivotally mounted cover member between its open position and its closed position.

The above, and still further highly important objects and advantages of the invention will become apparent from the following detailed specification, appended claims, and attached drawings, wherein:

Figure 1:
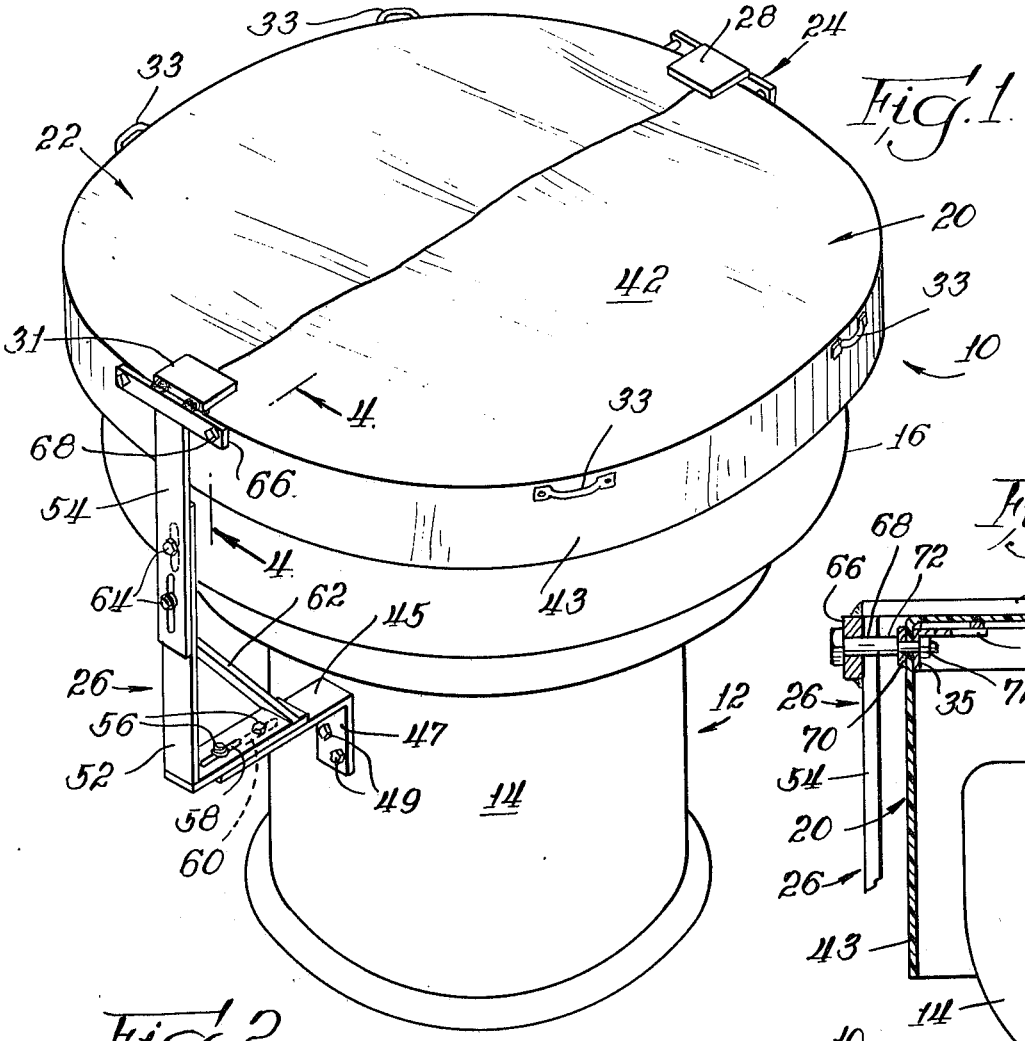
FIG. 1 is a pictorial view of a sound suppressing cover mounted on a vibratory finishing and deburring machine, the cover being constructed in accordance with the principles of the present invention.

Referring now to the drawings, and more particularly to FIG. 1 thereof, there is shown a generally circular sound suppressing cover 10 mounted on a vibratory deburring and finishing machine 12 and which is constructed in accordance with the present invention. It is to be understood that the cover of the present invention may also be used with other different types and kinds of machines for reducing sound levels. Moreover, the cover itself may be in different shapes, such as square, to accommodate different shapes of machines.

The machine 12 generally comprises a base 14 for supporting an opened mouth bowl or tub 16 by means of a set of springs 18, whereby the tub 16 is mounted in a floating manner so as to be vibrated by a motor (not shown). Finishing media (not shown) is disposed within the tub 16 for the purpose of deburring and finishing parts (not shown). The cover of the present invention may be used with different types and kinds of vibratory deburring and finishing machines, and such machines may, for example, be purchased from Ultramatic Equipment Company of Addison, Ill.

Figure 3:
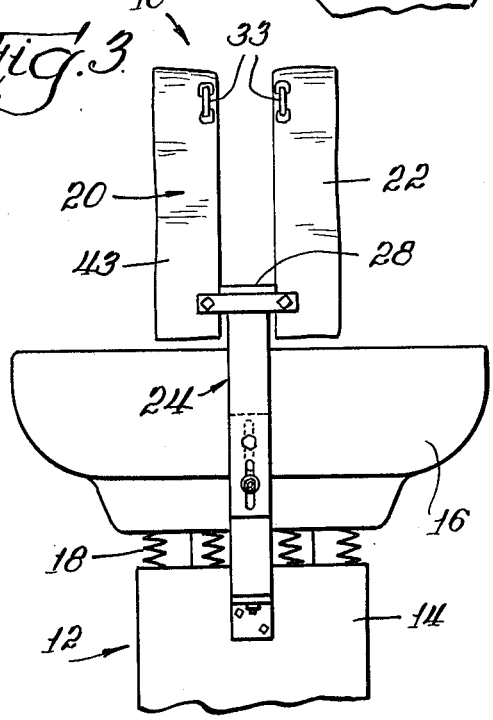
FIG. 3 is a fragmentary side-elevational view in reduced scale of the cover and machine of FIG. 1 illustrating both cover members disposed in their open positions.

The cover 10 generally comprises a pair of semi-circular cover members 20 and 22 which are connected to and supported by a pair of oppositely-disposed brackets 24 and 26. As shown in FIG. 1 of the drawings, the cover members are disposed in a horizontal plane in their closed position to at least partially cover over the machine 12, and as shown in FIG. 3 of the drawings, the cover members 20 and 22 can swing to an open position in an upstanding position as hereinafter described in greater detail. A pair of stop blocks 28 and 31 mounted on top of the respective brackets 24 and 26 limit the movement of the pivotally mounted cover members 20 and 22 between their open positions and their closed positions as hereinafter described in greater detail. A series of handles 33 extend radially outwardly from the cover members to facilitate the movement of the cover members between their open and closed positions. Considering the cover members in greater detail with reference to the drawings, the cover member 20 will now be described in greater detail, it being understood that the cover member 22 being similar to the cover member 20. The cover member 20 includes a rigid metal semi-circular frame 35 having stiffening webs 39 for helping support a series of radially-extending spokes 40. An expanded metal mesh material 41 is used as a covering for the frame 35 and is welded thereto to serve as a baffle for helping absorb sounds. The expanded metal mesh material 41 also enables the covers to be lighter in weight and therefore easier to operate.

In order to obtain a high degree of sound level suppression, the frame 35 is covered with a sound suppressing flexible sheet of material having a top portion 42 overlying the frame 35 and having a depending skirt portion 43 integrally connected to and extending from the top portion 42. The flexible material is preferably one-eighth of an inch thick and is composed of a suitable sound suppressing material, such as flexible vinyl material impregnated with barium sulfate and sold under the name "WHISPER MAT" by Noise Control Products of Northbrook, Ill.

Figure 2:
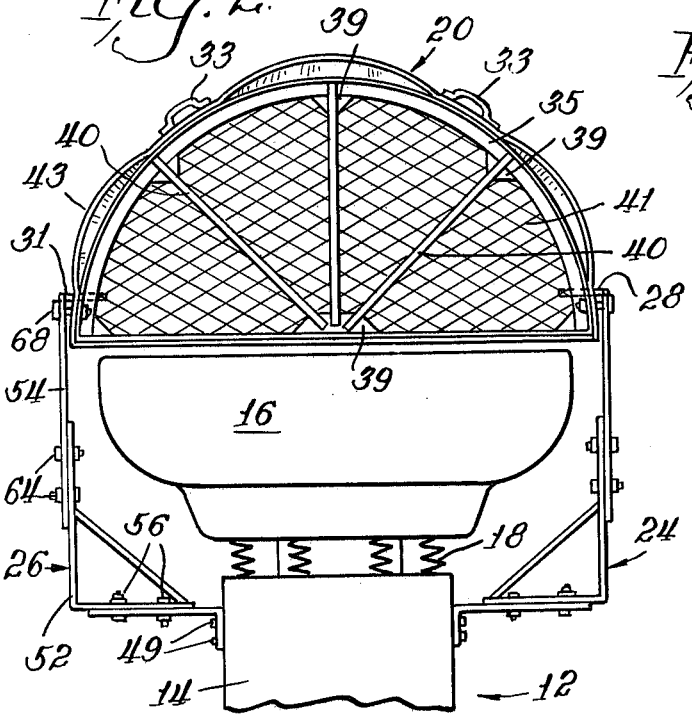
FIG. 2 is a fragmentary front-elevational view in reduced scale of the cover and machine of FIG. 1, illustrating one of the cover members in its open position.

Considering now the brackets in greater detail with reference to FIGS. 2, 3 and 4 of the drawings, the bracket 26 will now be described, it being understood that the bracket 24 is similar to the bracket 26. The bracket 26 generally includes a radially extending strip 45 having a depending flange 47 which is connected to the base 14 by bolts 49. An L member 52 interconnects adjustably the radially extending horizontal strip 45 with a vertically extending strip 54. As best seen in FIG. 1 of the drawings, a pair of nuts and bolts 56 fasten together releasably the horizontal portion of the L member 52 and the radially extending horizontal strip 45. In order to positionally adjust the bracket 26 in a radial direction, an elongated slot 58 in the horizontal portion of the L member 58 is aligned with a hole (not shown) in the horizontal strip 45, and similarly an elongated slot 60 in the horizontal strip 45 receives the other one of the nuts and bolts 56 and is aligned with a hole in the horizontal portion of the L member 52. A transverse brace 62 extends angularly between the horizontal and vertical portions of the L member 52.

In order to enable the bracket 26 to be adjusted vertically, a pair of nuts and bolts 64 fasten releasably the vertical portion of the L member 52 to the vertical strip 54 in an adjustable manner as previously described in connection with the strip 45.

A cross block 66 is welded to the vertical strip 54 and supports the stop block 31 which is welded thereto.

Figure 4:
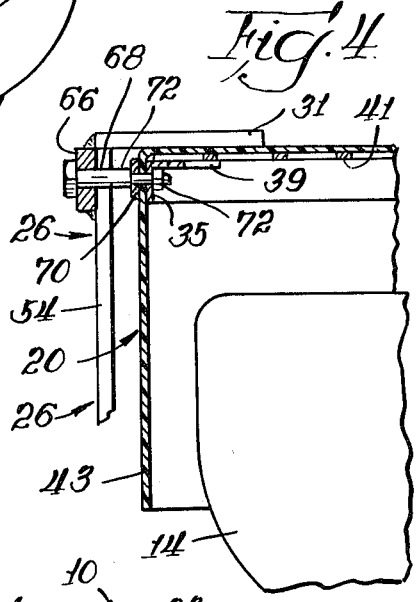
FIG. 4 is a cross-sectional view in increased scale of the cover and machine of FIG. 1 taken substantially along the line 4—4 thereof.

As shown in FIG. 4 of the drawings, in order to pivotally connect the cover member 20 to the bracket 26, a pair of shoulder bolts, such as a shoulder bolt 68 extends through a hole in one end portion of the cross block 66 and through a washer 70 aligned with a pair of aligned holes in the skirt 43 and in the frame 35. A nut 72 is tightened onto the end of the bolt 68 to secure its shoulder against the washer 70 and its head against the block 66.

It should be noted that the shoulder bolt 68 serves as one pivot point for one end of the cover member 20, and a similar connection is provided at the opposite end of the cover member 20. As a result, the semi-circular cover member 20 pivots about an axis extending parallel to the diameter thereof, and spaced a short distance therefrom. Therefore, the top portion 42 of the cover member 20 engages the underside of the blocks 28 and 31 when the cover member 20 is disposed in its horizontal closed position as shown in FIG. 1 of the drawings. The end of the blocks 28 and 31 engage the top portion 42 of the cover member 20 when it is moved to its upstanding vertical open position as shown in FIGS. 2 and 4 of the drawings.

It should be noted that the sheet of sound suppressing material is attached to the frame by the handles 33 and the shoulder bolts.

As shown in FIG. 4 of the drawings, when in its closed position, the skirt 43 is spaced a slight distance from the tub 14 and is mounted separately therefrom to prevent any vibration from being imparted thereto. The cover members are supported from the stationary base 14.

When in their closed position, the cover members 20 and 22 are disposed in a common plane to form a circular cover as shown in FIG. 1 of the drawings. Either one or both of the cover members may be grasped by their handles 33 and swung upwardly into their vertical open position against the elongated stop blocks 28 and 31 to permit access to the tube 16. It should be noted that as shown in FIG. 3 of the drawings, when the cover members are disposed in their open positions, the entire mouth of the tub is open and easy access thereto is permitted.

While the present invention has been described in connection with a particular embodiment thereof, it will be understood that those skilled in the art may make many changes and modifications without departing from the invention. For example, various different kinds of materials, such as rigid plastic materials, may also be employed for the frame 35, which is preferably entirely constructed of metal parts as disclosed herein. Accordingly, it is intended by the appended claims to cover all such changes and modifications as fall within the true spirit and scope of the invention.

What is claimed is:

1. A cover for suppressing sound from a machine, comprising: a pair of oppositely-disposed spaced-apart brackets adapted to be mounted on opposite sides of the machine; a pair of cover members having sound suppressing material thereon and connected to and supported by said brackets extending in a cantilevered manner therefrom and in a closed position at least partially over the machine, attaching means supported by one of said brackets for mounting pivotally at least one of said cover members to said one of said brackets to enable the pivotally attached cover member to move to an upstanding disposition in an open position; and stop means for limiting the movement of the pivotally mounted cover member between its open position and its closed position, said stop means having a first surface for engaging and holding down the upper surface of said one of said cover members at one side of the pivotal connection to support said one of said cover members in its horizontal closed position with the major portion thereof extending at the other side of its pivotal connection in a cantilevered manner and having a second surface for engaging the upper surface of the opposite side of said pivotal connection when said one of said cover members is moved to its open position to position it thereat.

2. A cover according to claim 1, wherein each one of said cover members includes a frame, said sound suppressing material being a flexible sheet secured to said frame.

3. A cover according to claim 2, wherein each one of said cover members includes a depending skirt portion.

4. A cover according to claim 2, wherein said sound suppressing material is composed of barium sulfate impregnated vinyl.

5. A cover according to claim 2, wherein said frame includes expanded metal.

6. A cover according to claim 1, wherein said stop means includes at least one block, said first surface being the underside of said block and said second surface being an end face of said block, said cover members abutting the underside of said block when in their horizontal closed position and abutting the end face of said block when in their upstanding open position.

7. A cover according to claim 6, wherein said stop means includes a second block supported by said brackets, the first mentioned and said second blocks being similar to one another.

8. A cover according to claim 7, further including means for enabling the length of said brackets to be adjusted vertically.

9. A cover according to claim 7, further including means for enabling the length of radially extending portions of said brackets to be adjusted.

* * * * *